US007544138B2

(12) United States Patent
Weber et al.

(10) Patent No.: US 7,544,138 B2
(45) Date of Patent: Jun. 9, 2009

(54) TRAINING METHOD FOR CATCHING SPORTS BALLS

(76) Inventors: Mark A. Weber, 1720 Kaliste Saloom Rd., Suite 9-A, Lafayette, LA (US) 70508; Lance Strother, 206 Trent Dr., Broussard, LA (US) 70508

( * ) Notice: Subject to any disclaimer, the term of this patent is extended or adjusted under 35 U.S.C. 154(b) by 0 days.

(21) Appl. No.: 11/899,322

(22) Filed: Sep. 5, 2007

(65) Prior Publication Data

US 2007/0298912 A1 Dec. 27, 2007

Related U.S. Application Data

(63) Continuation of application No. 11/163,743, filed on Oct. 28, 2005, now abandoned.

(51) Int. Cl.
*A63B 69/38* (2006.01)
*A63B 69/00* (2006.01)

(52) U.S. Cl. ..... 473/450; 473/464; 473/458; 473/576; 273/330

(58) Field of Classification Search ..... 473/422, 473/450, 458, 464, 423, 506, 219, 59, 61; 482/105, 108, 139, 49, 44; 434/247, 248, 434/251; 2/16, 20, 159, 161, 6
See application file for complete search history.

(56) References Cited

U.S. PATENT DOCUMENTS 2,077,202 A * 4/1937 Barrie ..... 119/14.22
2,845,628 A * 8/1958 Dell ..... 2/20
3,169,019 A * 2/1965 Conrad ..... 473/457
3,229,979 A * 1/1966 Smoak, Jr. ..... 273/330
3,413,000 A * 11/1968 Alkonis ..... 473/61
3,496,573 A * 2/1970 Pope et al. ..... 2/161.6
3,501,773 A * 3/1970 Stansberry et al. ..... 2/159
3,581,312 A * 6/1971 Nickels ..... 2/159
3,606,614 A * 9/1971 Dimitroff ..... 2/159
3,635,476 A * 1/1972 Breslow et al. ..... 273/390
3,640,177 A * 2/1972 Hottinger ..... 89/33.4
3,843,126 A * 10/1974 Bandy ..... 473/576
4,034,981 A * 7/1977 Veneziano ..... 473/464
4,131,102 A * 12/1978 Polly, Jr. ..... 124/5
4,268,254 A * 5/1981 McCormick ..... 434/247
4,496,151 A * 1/1985 Tureaud ..... 473/59
4,836,555 A * 6/1989 Wexler ..... 273/330
5,236,190 A * 8/1993 Moss ..... 473/450
5,833,233 A * 11/1998 Strug ..... 473/450
5,961,406 A * 10/1999 Hass ..... 473/576
D479,864 S * 9/2003 Maham ..... D21/662
6,757,915 B2 * 7/2004 Sidlo ..... 2/16
6,785,909 B1 * 9/2004 Li ..... 2/16
6,991,553 B2 * 1/2006 Park et al. ..... 473/219

* cited by examiner

OTHER PUBLICATIONS

Flyball Home Page—Definitive Guide to Ball Sizes—copyright 1996 Kathryn Hogg http://flyballdogs.com/balls/9/18/08 7:52:21 PM.*

*Primary Examiner*—Mitra Aryanpour
(74) *Attorney, Agent, or Firm*—Ted M. Anthony

(57) ABSTRACT

An apparatus, that places an object ball in the palm of both hands of an athlete, for training the athlete to catch a thrown sports ball with fingertips and thumb tips rather than palms. The size of the object ball can be increased as the athlete's skill level improves. This apparatus teaches the athlete to control the sports ball with the fingertips and thumb tips. Because this apparatus is small and lightweight it can be used for training as well as performance enhancement.

2 Claims, 3 Drawing Sheets

TRAINING METHOD FOR CATCHING SPORTS BALLS

CROSS REFERENCES TO RELATED APPLICATIONS

Continuation of U.S. patent application Ser. No. 11/163,743, filed Oct. 28, 2005, now abandoned

STATEMENTS AS TO RIGHTS TO INVENTIONS MADE UNDER FEDERALLY SPONSORED RESEARCH AND DEVELOPMENT

None

FIELD OF INVENTION

This invention relates generally to a sports training apparatus and more specifically an apparatus to train an athlete to handle a sports ball with fingertips and thumb tips.

BACKGROUND OF INVENTION

The invention disclosed herein generally relates to the field of athletic teaching devices. More particularly, the present invention relates to devices for training technique for catching a thrown football with fingertips and thumb tips, also setting a volleyball, shooting and dribbling a basketball with fingertips and thumb tips.

The present invention is intended for use primarily by football, volleyball, and basketball players as a training aid to enhance the ability of players to catch a thrown football, set a volleyball, as well as shoot and dribble a basketball.

Fingertip control and "soft hands" are critical to many sports. Relevant sports include football, basketball, baseball, volleyball, soccer and rugby. In these sports the athlete must control the ball with the fingertips.

DETAILED DESCRIPTION

The apparatus is strapped around the athlete's hands with the object ball resting in the palm of each hand. The invention is designed to develop "fingertip control" and "soft hands", requiring the ball to be caught, set, shot, or dribbled by using the fingertips. In the technique, the ball is caught, set, shot, or dribbled with the fingertips and thumb tips, and should not come in contact with the palm of the hands.

The body of the invention is an object ball strapped around the athlete's hand with the object ball resting in the palm of both of the athlete's hands. As the skill of the player increases, the size of the object balls can be increased. The larger the object balls the better the athlete's technical mechanics will have to be.

The invention is designed to train the user to catch a sports ball with fingertips and thumb tips rather than palms, comprising: a ball strapped around the hand with the object ball resting in the palms. The strap is inserted thru the object ball and wraps around the back of the hand.

SUMMARY OF THE INVENTION

The invention is designed to provide effective visual feedback after each use, to indicate if the ball has improperly contacted the palm of the hand. The result of the improper contact with the palm will be a dropped or bobbled ball.

One primary objective of this present invention is to provide a catch training apparatus encouraging catching a football with fingertips and thumb tips rather than palms. Another primary objective of this present invention is to provide a set training apparatus encouraging setting a volleyball with fingertips and thumb tips rather than palms.

Another primary object of the present invention is to provide a fingertip control training apparatus that will use negative reinforcement when the ball improperly contacts the palm.

Another object of the present invention is to provide a fingertip control training apparatus having construction that is relatively rugged and resistant to sweat or water.

Another object of the present invention is to provide a fingertip control training apparatus that is relatively easy and inexpensive to manufacture.

Another object of the present invention is to provide a fingertip control training apparatus that is relatively easy to operate.

Another object of the invention is to provide a ball attached to the palm for exercising a person's hands and forearms.

DETAILED DESCRIPTION OF THE INVENTION

Figure 1:
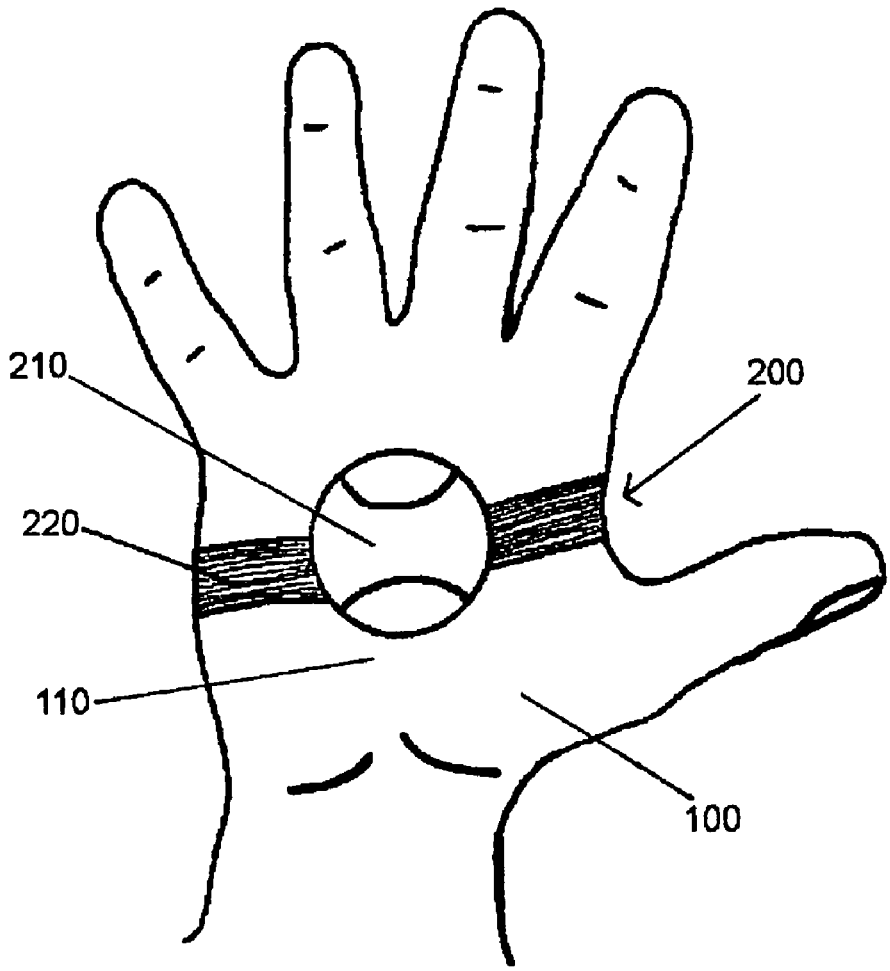
FIG. 1 is a plan view of the sports ball catch training apparatus palm side up.

Referring to FIG. 1, there is shown a top plan view, of the athlete's hand 100 palm up wearing the apparatus 200, of the invention. The apparatus comprises an object ball 210, an elastic strap 220, and a comfort patch 230. The object ball 210 is a lightweight, small, flexible ball such as a mini tennis ball. The elastic strap 220 runs through the object ball 210 and around the athlete's hand 100 and secures the object ball 210 in the middle of the athlete's palm 110.

Figure 2:
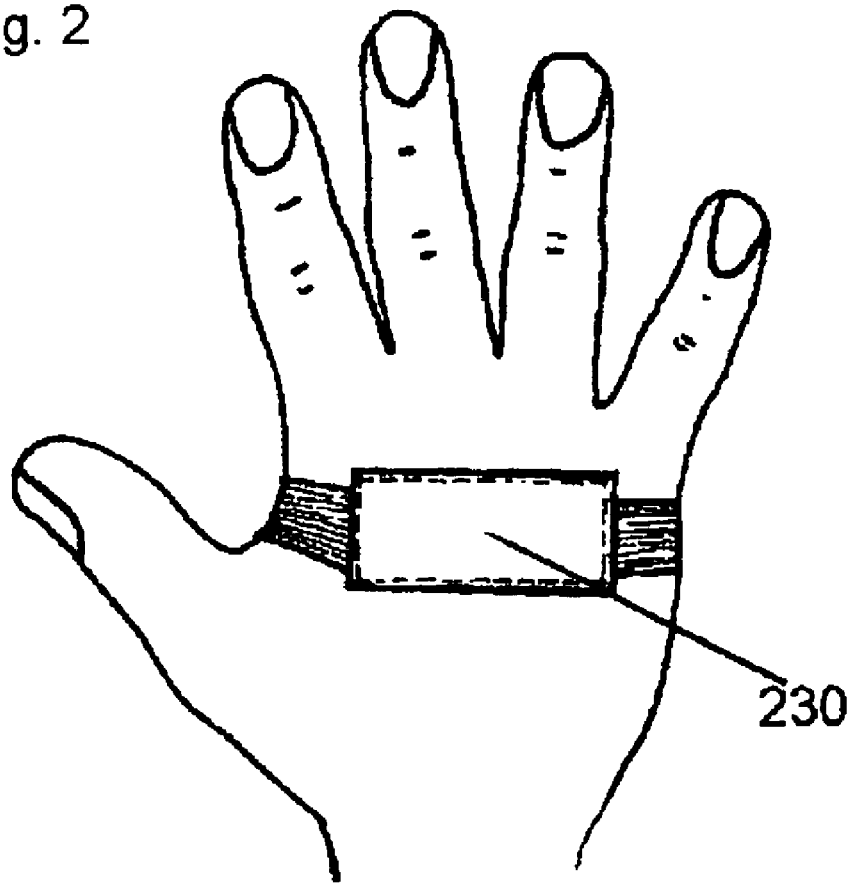
FIG. 2 is a plan view of the sports ball catch training apparatus palm side down.
Figure 3:
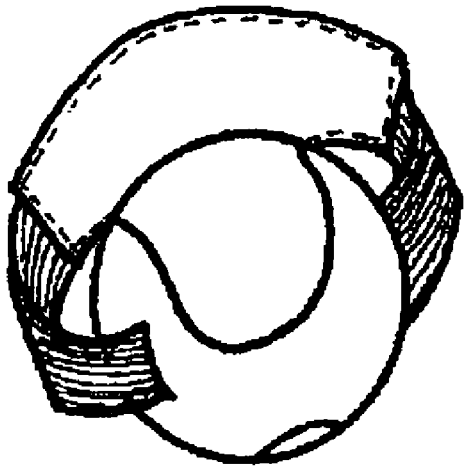
FIG. 3 is a plan view of the sports ball catch training apparatus in accordance with the present invention.
Figure 4:
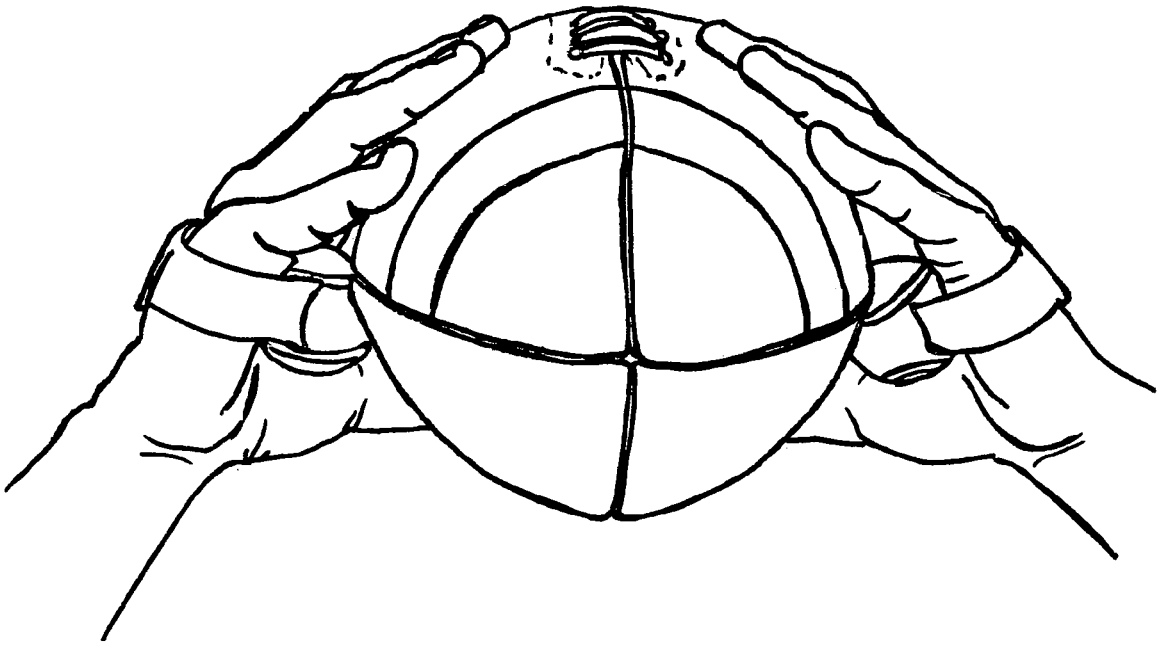
FIG. 4 is a plan view of the catching of a sports ball using the sports catch training apparatus of the present invention disposed on the user's first and second hands.

Referring to FIG. 2, there is shown a top plan view, of the athlete's hand 100 palm down wearing the apparatus 200, of the invention. The comfort patch 230 is made of a lightweight, flexible material such as vinyl or leather.

Once an athlete begins to master the particular technical mechanics of this apparatus 200, automatic processing occurs due to the synergy between physical, technical, and mental processes that result through continual, quality practice.

The above disclosed invention has a number of particular features which should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for training the catching of sports balls using finger tips and thumb tips of hands comprising the steps of:

a. securing a training apparatus to a first hand connected to a first forearm, said training apparatus comprising:

i. a mini tennis ball disposed in the palm of said first hand; and ii. an elastic strap having a first end and a second end, wherein said elastic strap passes through said mini tennis ball and around said hand, and said first and second ends of said elastic strap are connected to each other;

b. securing a training apparatus to a second hand connected to a second forearm, said training apparatus comprising:

i. a mini tennis ball disposed in the palm of a second hand; and ii. an elastic strap having a first end and a second end, wherein said elastic strap passes through said mini tennis ball and around said hand, and said first and second ends of said elastic strap are connected to each other;

c. catching a sports ball with said first and second hands; and d. increasing the size of said mini tennis balls as skill catching said sports ball improves, such that the larger the mini tennis balls, the better the technical mechanics of catching said sports balls must be.

2. The method of claim 1, further comprising the step of squeezing said mini tennis balls to exercise said first and second hands.

* * * * *